United States Patent [19]

Dreesen et al.

[11] 4,364,704

[45] Dec. 21, 1982

[54] GRAB BUCKET SUSPENDED FROM HOISTING INSTALLATION

[75] Inventors: Peter Dreesen, Essen; Klaus Kiessling, Wetter, both of Fed. Rep. of Germany

[73] Assignee: Mannesmann-Demag AG, Fed. Rep. of Germany

[21] Appl. No.: 204,234

[22] Filed: Nov. 5, 1980

[30] Foreign Application Priority Data

Nov. 13, 1979 [DE] Fed. Rep. of Germany ..... 2945746

[51] Int. Cl.[3] ..... B86D 1/48

[52] U.S. Cl. ..... 414/624; 37/DIG. 1; 414/674

[58] Field of Search ..... 414/624, 625, 626, 674; 212/159, 161, 220, 221, 251, 259, 127; 37/DIG. 1

[56] References Cited

U.S. PATENT DOCUMENTS 4,047,311 9/1977 Kelley ..... 414/624 X

FOREIGN PATENT DOCUMENTS 1025255 1/1953 France ..... 414/624

*Primary Examiner*—Robert G. Sheridan

*Attorney, Agent, or Firm*—Mandeville and Schweitzer

[57] ABSTRACT

The disclosure is directed to a grab bucket suspended from the cable of a hoisting means. The hosting means includes a first reversible motor drive means to raise and lower the grab bucket and a second motor drive means is associated with the grab bucket for opening and closing the bucket. Pursuant to the invention, a slack line limit switch is arranged and configured to detect a slackening condition in the cable as when the bucket reaches a pile of material. Upon said slackening condition, the limit switch operates to stop the first reversible motor drive means and to start the second reversible motor drive means to commence the closing of the bucket. Moreover, a timer relay means is also associated with the slack line limit switch and is operative after the detection of the slackening condition in the cable to time out after several predetermined periods to operate the first and second motor drive means in a preselected sequence, to raise the closing bucket somewhat above the pile, suspend the bucket above the pile until it is fully closed, and thereafter raise the bucket to a final destination position.

5 Claims, 2 Drawing Figures

GRAB BUCKET SUSPENDED FROM HOISTING INSTALLATION

BACKGROUND AND SUMMARY OF THE INVENTION

The present invention is directed to a grab bucket of the type which is suspended from a cable so that it may be lowered to a pile of material such as sand or gravel to grab and lift an amount of such material. The bucket is designed to open and close whereby the bucket, in the open position, is lowered into the pile, closed to capture a portion of the material, and then lifted by the cable to remove the captured material to another location.

Pursuant to one prior art proposal disclosed in the F.R. Germany Publication DE-AS No. 22 00 799, an electrical switching unit is provided to control the operation of a grab bucket. The switching unit automatically and temporarily energizes the lifting motor to facilitate a quick closing of the bucket. However, the "grabbing" quality of the buckets generally used in apparatuses of this type is so effective that such buckets tend to dig themselves into the pile of material as they close so that the bucket becomes overfilled with material. Typically, the excess material spills over the open top of the bucket. Moreover, the burrowing effect of the bucket closing motion impedes a fast and full closing of the bucket since the amount of material within and surrounding the bucket offers considerable resistance to the closing motion. Consequently, a considerable amount of energy is required to effect a full closing and despite a high energy input, the bucket may still emerge from the pile not fully closed.

It is a primary objective of the present invention to provide a grab bucket apparatus of the above-described type including new and improved electrical control means to overcome the problems of the prior art while providing a fast and efficient bucket operation with decreased energy consumption. Pursuant to the invention, a slackline limit switch detects a slacking condition in the bucket-lifting cable, as when the open bucket has engaged the top of the pile. The limit switch thereupon automatically de-energized the lowering motion for the cable and energizes the means for closing the bucket.

Pursuant to an important feature of the invention, the slackline limit switch also energizes several timer relay means set to time out at various times to initiate a predetermined sequence of bucket operations. More specifically, the timer relay means are electrically associated with one another and other electrical control devices to automatically control and co-ordinate the closing and lifting of the grab bucket. When the closing of the bucket commences, several timer relays are activated to commence timing. Before full closure of the bucket, one of the timers times out thereby energizing the hoisting motor to commence the lifting of the bucket from the pile. A second timer relay times out after the bucket has been hoisted above the pile to stop the lifting motion so that the bucket is positioned slightly above the pile just before it is fully closed. In this manner, there will be no resistance from the pile to the closing bucket motion so that the bucket may be fully closed with minimal energy consumption. Another timer then times out to re-energize the hoisting mechanism so that the bucket may be raised to its destination.

It has been found that a grab bucket of the type utilized in the system of the present invention is completely filled with the material grabbed during the first quarter of the closing process. Accordingly, by lifting the bucket from the pile before a full closure of the bucket, pursuant to the teaching of the invention, there is no loss in the amount of material grabbed while there is considerable savings in the amount of energy needed to fully close the bucket. Thus, the present invention teaches a means for utilizing a grab bucket to its fullest potential while providing a highly energy-efficient operation.

For a more complete understanding of the above and other features and advantages of the invention, reference should be made to the following detailed description of a preferred embodiment of the invention together with the accompanying drawings.

DETAILED DESCRIPTION OF A PREFERRED EMBODIMENT OF THE INVENTION

Figure 1:
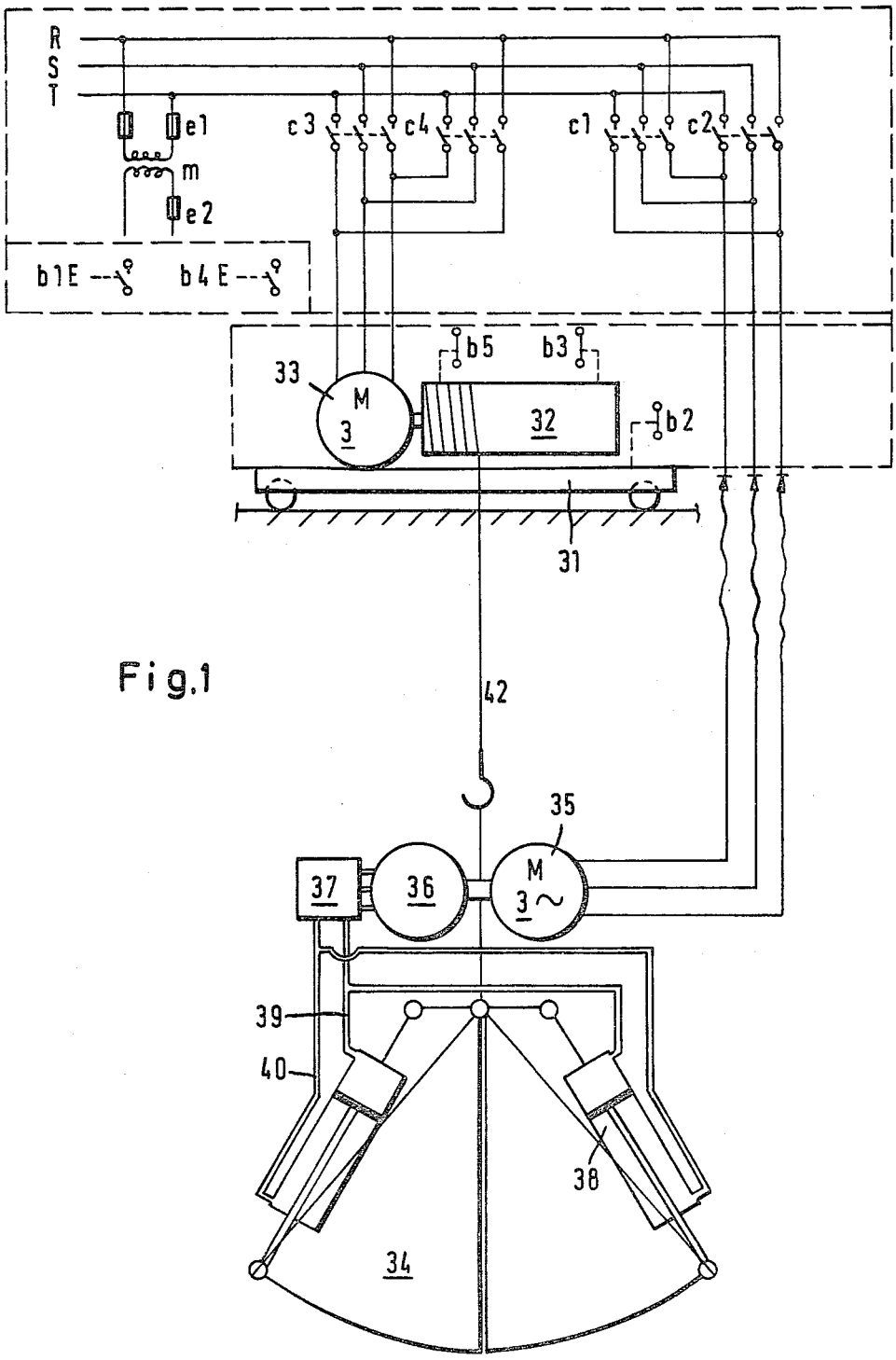
FIG. 1 is a simplified drawing of grab bucket apparatus and associated circuitry in accordance with the invention.
Figure 2:
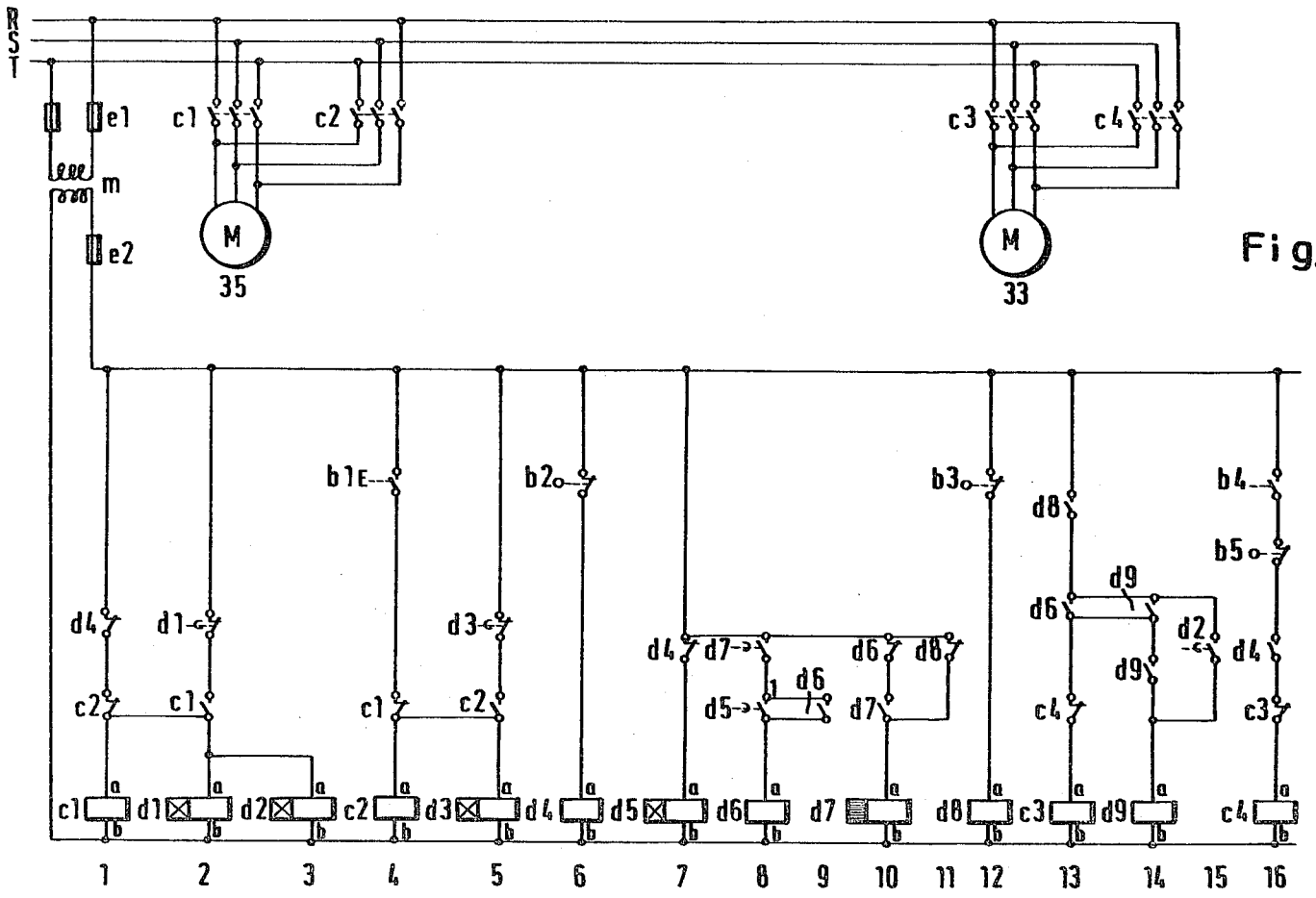
FIG. 2 is a schematic diagram of the electrical control circuit for the grab bucket in accordance with the invention.

Referring now to the drawings and intially to FIG. 1, a cable drum 32 is mounted on a movable trolley 31 of a conventional crane (not specifically illustrated) and is mechanically coupled to a reversible, electrical motor 33 for rotation in the clockwise or counter-clockwise direction. A cable 42 is wrapped around the drum 32 and supports a grab bucket 34. The grab bucket 34 includes a reversible motor 35 mechanically coupled to a pump 36 which operates an hydraulic system comprising a control valve 37 and fluid lines 39, 40. The fluid lines 39, 40 are interconnected with fluid cylinders 38 whereby operation of the fluid cylinders 38 by the hydraulic system is effective to open and close the grab bucket 34. A lowering limit switch b5 is associated with the cable drum 32 and is activated by the cable 42 when it is substantially unwound from thd drum 32. A hoisting limit switch b5 is also associated with the drum 32 and is activated when the cable 42 is fully wound onto the drum 32.

Pursuant to the invention, a slackline switch b2 is mounted on the trolley 31 and is arranged and configured to detect and be activated by a slackening condition in the cable 42. Accordingly, when the grab bucket 34 has been lowered onto a pile of material, the cable 43 will begin to slacken and thereby activate the slackline switch b2 which automatically commences operation of the electrical switching system of the invention, as will appear.

A bucket opening switch b1 and lowering switch b4 together with the remaining elecrical control components of the invention may be located at the crane or an operator's cabinet, as desired. The various circuit elements are connected to electrical feedlines R, S and T through fuses e1, e2 and control transformer m. The feedlines R, S and T are connected to the bucket motor 35 through three normally-open contacts of a multiple contact, magnetic relay switch c1 and three normally-open contacts of a multiple contact, magnetic relay switch c2. In a similar manner, the hoisting motor 33 is connected to the feedlines R, S and T through three normally-open contacts of a multiple contact, magnetic relay switch c3 and three normally-open contacts of a multiple contact, magnetic relay switch c4.

To commence the operation of the grab bucket 34, the bucket opening switch b1 is closed momentarily to close circuit line 4 thereby energizing the magnetic relay of relay switch c2. This closes the three normally-open contacts of the switch c2 interconnecting the feedlines R, S and T and bucket motor 35, whereby the motor operates the cylinders 38, through the pump 36 valve 37 and hydraulic lines 39, 40 to open the bucket 34. Activation of the magnetic relay of relay switch c2 also closes the contact c2 in circuit line 5 to energize the timer relay d3 and also to hold itself in the energized condition after the opening button b1 is relaesed. At the expiration of the time period of the timer relay d3, the contact d3 is opened to de-energize the relay of magnetic switch c2 thereby stopping bucket motor 35.

To lower the grab bucket 34, the lowering switch b4 is closed to close circuit line 16 whereby the magnetic relay of switch c4 is energized to close the three contacts of relay switch c4 interconnecting the feedlines R, S and T with the hoisting motor 33. The motor 33 will operate the drum 32 to lower the bucket 34 to a pile of material. If the cable 42 is fully unwound before the bucket 34 reaches the pile of material, the limit switch b5 will be activated to open a normally-closed contact in circuit line 16 to thereby stop the hoisting motor 33. However, if the grab bucket 34 reaches the pile of material before the cable 42 is fully unwound, the cable 42 will begin to slacken whereby the slackening condition is detected by the limit switch b2.

At this time, the slackline limit switch b2 will open its normally-closed contact in circuit line 6 to de-energize the relay of multiple contact relay switch d4. The de-energization of the magnetic coil d4 in circuit line 6 acts to open the associated contact d4 in circuit line 16 to stop the hoisting motor 33. Simultaneously, the normally-closed contacts of the switch d4 in circuit lines 1 and 7 will close, energizing the magnetic relay of the switch c1 and the timer relay switch d5 in circuit lines 1 and 7, respectively.

Energization of the magnetic relay c1 closes the normally-open contacts interconnecting feedlines R, S and T and bucket motor 35 to run the motor in a reverse direction whereby the pump 36, valve 37 and hydraulic lines 39, 40 will operate the cylinders 38 to close the bucket 34. Accordingly, the bucket 34 will begin to grab a portion of material of the pile on which it rests. The energized relay c1 will close its normally-open contact c1 in circuit line 2, thereby energizing timer relays d1 and d2.

When the timer relay d5 times out, the contact thereof in circuit line 8 is closed to energize the magnetic relay of relay switch d6 which closes its contact in circuit line 13 to energize the relay c3. This serves to close the three contacts of the switch c3 interconnecting the motor 33 with the feedlines R, S and T. Accordingly, the motor 33 will begin to operate to lift the grab bucket 34 from the pile. The timer relay d5 is set to time some time after the bucket 34 has begun to close.

Simultaneously with the energization of relay c3, the switch d6 of circuit line 10 is opened, cancelling the holding pattern of the delayed release time relay d7. After a predetermined amount of time, the delayed release time relay d7 opens its contact in circuit line 8 to de-energize the magnetic relay d6. Upon de-energization of the magnetic relay d6, its contact in circuit line 13 is opened to interrupt power to the hoisting motor 33.

The predetermined time for the delayed release time relay d7 is calculated whereby the hoisting or lifting motion of the bucket 34 is interrupted just as the bucket 34 clears the pile of material, but prior to full closing of the bucket 34. Thus, the bucket 34 may be fully closed while it is suspended just above the pile so that the material of the pile does not offer resistance to the final closing motion.

Subsequent to the interruption of the hoisting of the grab bucket 34, the timer relay d2 times out to close the contact thereof in circuit line 15, thereby energizing the magnetic relay of switch d9. The energized relay d9 will hold itself in the on condition by the closing of two of its contacts d9 in circuit line 14. Upon closing of the contacts d9 in circuit line 14, the magnetic coil of switch c3 in circuit line 13 is re-energized to start the hoisting motor 33 once again. At about the same time, the time relay d1 times out opening the contact thereof in circuit line 2 to de-energize relay c1, thereby stopping the bucket motor 35 at the time when the grab bucket 34 is fully closed The hoisting motor 33 will thereafter continue to lift the grab bucket 34 until the cable 42 is nearly fully wound onto the drum 32 whereupon the limit switch b3 is activated by the cable to open its contact in circuit line 12 to de-energize the relay of magnetic relay switch d8. This will open the contact of the switch d8 in circuit line 13 to turn off the hoisting motor 33 with the bucket 34 in the fully lifted position.

Simultaneously therewith, the normally-closed contact of the switch d8 in circuit line 11 is closed to reset delayed release time relay d7. In this manner, the circuit of the invention is reset for a subsequent automatic grabbing operation.

The automatic switching means of the present invention facilitates a secure closing of the grab bucket 34 without any resistance from the material of the pile and with a greatly reduced energy requirement. This not only improves the operation of the grab bucket 34, but also lengthens the worklife and durability of the electrical switching apparatuses, the bucket motor 35, the pump 36, control valve 37 and hydraulic lines 39, 40.

The above-described embodiment of the invention is meant to be representative only, as certain changes may be made therein, by a person skilled in the art, without departing from the clear teachings of the invention. Accordingly, reference should be made to the following appended claims in determining the full scope of the invention.

We claim:

1. An apparatus for lifting material from a pile, which comprises:

(a) a grab bucket being operative to open and close, (b) a hoisting means including a cable for suspending said grab bucket and lowering and raising said grab bucket from said pile, (c) said hoisting means including a first reversible motor drive means associated with said cable to raise and lower said grab bucket, (d) a second reversible motor drive means associated with said grab bucket for opening and closing said grab bucket, and (e) electrical control means associated with said first and second motor drive means and including:

(i) a slackline limit switch to detect a slackening condition in said cable whereby upon said slackening condition said limit switch stops said first motor drive means and starts said second motor to close said grab bucket, and (ii) timer relay means associated with said slackline limit switch and operative after predetermined time out periods to operate said first and second motor drive means in a predetermined sequence to close said bucket, raise said closing bucket above the pile, suspend the bucket above the pile until it is fully closed and raise the bucket to a destination position.

2. The apparatus according to claim 1, furthur characterized by:

(a) said timer relay means including:

(i) a first timer relay activated by said slackline limit switch and set to time out during the closing of said grab bucket to operate the first motor drive means to lift the grab bucket, (ii) delay timer relay means activated by said first timer relay to stop said first motor drive means as the closing bucket clears said pile, (iii) a second timer relay activated by said slackline limit switch and set to time out when the bucket is closed to stop said second motor drive means, and (iv) a third timer relay activated by said slackline limit switch and set to time out when said bucket is closed to energize the first motor drive means to lift said bucket.

3. The apparatus according to claim 2, further characterized by:

(a) an auxiliary relay electromechanically interconnecting said first relay and said delay timer relay.

4. The apparatus according to claim 2, further characterized by:

(a) an auxiliary relay electromechanically interconnecting said third relay and said first motor drive.

5. The apparatus according to claim 1, further characterized by:

(a) an upper limit switch means associated with said cable and operative when said cable has raised the grab bucket to said destination position to stop said first motor drive.

* * * * *